US010258537B1

(12) United States Patent
Lamin

(10) Patent No.: US 10,258,537 B1
(45) Date of Patent: Apr. 16, 2019

(54) DUAL MASTURBATOR SYSTEM AND METHOD

(71) Applicant: Nazir Lamin, Lima, OH (US)

(72) Inventor: Nazir Lamin, Lima, OH (US)

( * ) Notice: Subject to any disclaimer, the term of this patent is extended or adjusted under 35 U.S.C. 154(b) by 91 days.

(21) Appl. No.: 15/232,730

(22) Filed: Aug. 9, 2016

Related U.S. Application Data

(60) Provisional application No. 62/204,681, filed on Aug. 13, 2015.

(51) Int. Cl.
*A61H 19/00* (2006.01)

(52) U.S. Cl.
CPC ..... *A61H 19/32* (2013.01); *A61H 2205/087* (2013.01)

(58) Field of Classification Search
CPC ..... A61H 19/00
USPC ..... 600/38–41
See application file for complete search history.

(56) References Cited

U.S. PATENT DOCUMENTS

| | | | | |
|---|---|---|---|---|
| 5,127,396 | A * | 7/1992 | McAllister | A61H 19/44 128/844 |
| 5,466,235 | A * | 11/1995 | Shubin, Sr. | A61H 19/00 600/38 |
| 7,452,326 | B2 * | 11/2008 | Fladl | A61H 19/34 600/38 |
| 8,690,754 | B2 * | 4/2014 | Smith | A61F 5/41 600/38 |
| 9,486,388 | B2 * | 11/2016 | Wright, Jr. | A61H 19/32 |
| 2007/0106109 | A1 * | 5/2007 | Ly | A61H 19/44 600/38 |
| 2013/0158446 | A1 | 6/2013 | Nan | |
| 2013/0289345 | A1 | 10/2013 | Rueda | |
| 2014/0378759 | A1 | 12/2014 | Fang et al. | |

* cited by examiner

*Primary Examiner* — Samuel Gilbert
(74) *Attorney, Agent, or Firm* — Integrity Patent Group, PLC; Charles E. Runyan

(57) ABSTRACT

A dual masturbator device for two adult males to masturbate simultaneously. The dual masturbator device has a Y-shaped design which permits entry of two male members for the purpose of mutual masturbation. The internal material mimics genital flesh, and allows the two adult males to feel each other through the material, increasing the sensation. The dual masturbator device also includes a temporary plug so that one opening can be used by a single male if preferred. The device can be made of clear material so that users are able to observe their members within the device.

19 Claims, 5 Drawing Sheets

DUAL MASTURBATOR SYSTEM AND METHOD

CROSS-REFERENCE TO RELATED APPLICATION

The present application is related to and claims priority from prior provisional application Ser. No. 62/204,681, filed Aug. 13, 2015 which application is incorporated herein by reference.

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of masturbatory devices and more specifically relates to a dual masturbator system.

DESCRIPTION OF RELATED ART

Masturbation is the sexual stimulation of one's own genitals for sexual arousal or other sexual pleasure, usually to the point of orgasm. The stimulation may involve hands, fingers, everyday objects, sex toys such as vibrators, or combinations of these. Mutual masturbation (mutual manual stimulation of the genitals between partners) can be a substitute for sexual penetration. Studies have found that masturbation is frequent in humans of both sexes and all ages, although there is variation. Various medical and psychological benefits have been attributed to a healthy attitude toward sexual activity in general and to masturbation in particular. No causal relationship is known between masturbation and any form of mental or physical disorder.

Several attempts have been made to solve the above-mentioned problems such as those found in U.S. Pub. Nos. 2013/0158446 to Simon Siu Man Nan; 2014/0378759 to Shuo-Wei Fang et al.; and 2013/0289345 to Francisco D. Rueda. This art is representative of masturbatory devices. However, none of the above inventions and patents, taken either singly or in combination, is seen to describe the invention as claimed.

BRIEF SUMMARY OF THE INVENTION

In view of the foregoing disadvantages inherent in the known masturbatory device art, the present invention provides a novel dual masturbator system. The general purpose of the present invention, which will be described subsequently in greater detail is to provide a masturbatory device which allows two males to masturbate simultaneously using one motion.

A dual masturbator system is disclosed herein, in a preferred embodiment, comprising a dual masturbator device including a y-shaped body having an outer-circumference having a closed-end, an open-end-A having a first-orifice, and an open-end-b having a second-orifice, and an inner-cylindrical-tube having a soft-flesh-like-material. The dual masturbator device may measure exactly ten inches in length in preferred embodiments, and comprises flesh tones to mimic human flesh. The y-shaped body with the outer-circumference is useful for gripping the dual masturbator device while holding the closed-end, and the outer-circumference is washable using soap and warm water. The closed-end comprises a temporary-removable-plug allowing for a third orifice; wherein the open-end-A having the first-orifice, and the open-end-B having the second-orifice permit entry of two male members at once.

The open-end-A having the first-orifice accommodates one male penis for a single user, and the open-end-B having the second-orifice accommodates one male penis for dual users. Open-end-B includes a temporary-removable-plug to allow proper stimulation for a single user. The inner-cylindrical-tubing comprises soft-flesh-like-material, and the inner-cylindrical-tube consists of a flexible composition allowing for expansion and contraction during use. The inner-cylindrical-tube comprises an air outlet hole for allowing excess air to escape the dual masturbator device. The inner-cylindrical-tube and the soft-flesh-like-material is designed to mimic genital-flesh consistency. The inner-cylindrical-tube and the soft-flesh-like-material allows for insertion of a cleaning apparatus. The material comprises pliable rubber to provide stability and grippability during use. As such the y-shaped body and the inner-cylindrical-tube provides an instrument for masturbatory pleasure of two male members at once.

A method for using a dual masturbator system is also disclosed herein. The method for providing use for the dual masturbator device includes the steps of: step one, opening the dual masturbator device packaging; step two, cleaning the dual masturbator device thoroughly before first use; step three, inserting up to two male members into the dual masturbator device; step four, using the dual masturbator device until desired satisfaction has been achieved; step five, cleaning the dual masturbator device thoroughly after use; and alternately step six, using lubricant inside of the dual masturbator device.

The present invention holds significant improvements and serves as a dual masturbator system. Preferably, a masturbatory device should provide the option for two males to masturbate simultaneously using one motion and, yet would operate reliably and be manufactured at a modest expense. Thus, a need exists for a reliable dual masturbator system to avoid the above-mentioned problems.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present disclosure, dual masturbator system, constructed and operative according to the teachings of the present disclosure.

The various embodiments of the present invention will hereinafter be described in conjunction with the appended drawings, wherein like designations denote like elements.

DETAILED DESCRIPTION

Figure 1:
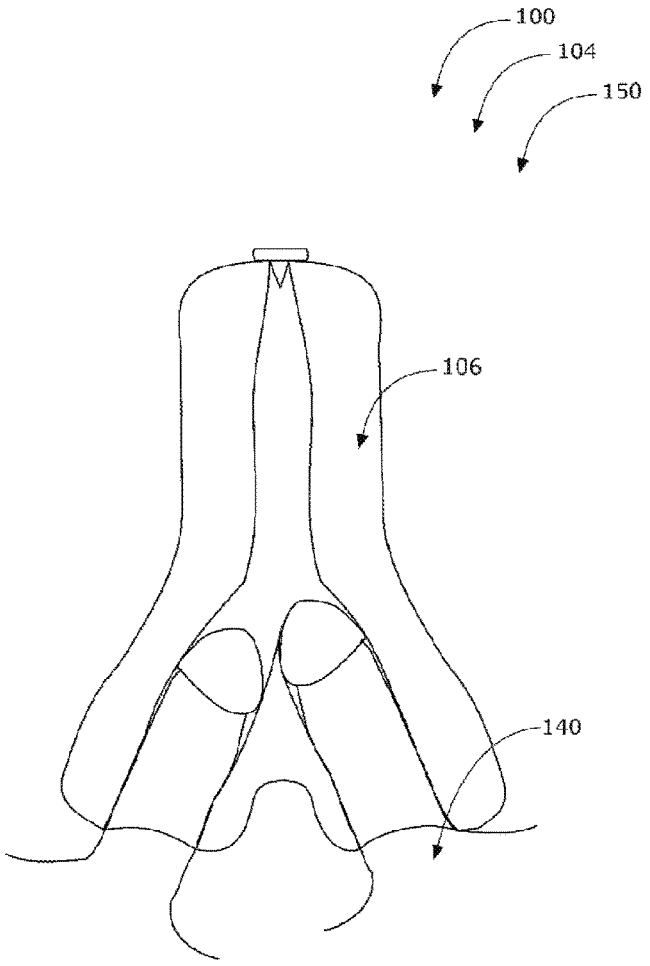
FIG. 1 shows a perspective view illustrating a dual masturbator system during an 'in-use' condition showing two members using the device according to an embodiment of the disclosure.
Figure 2:
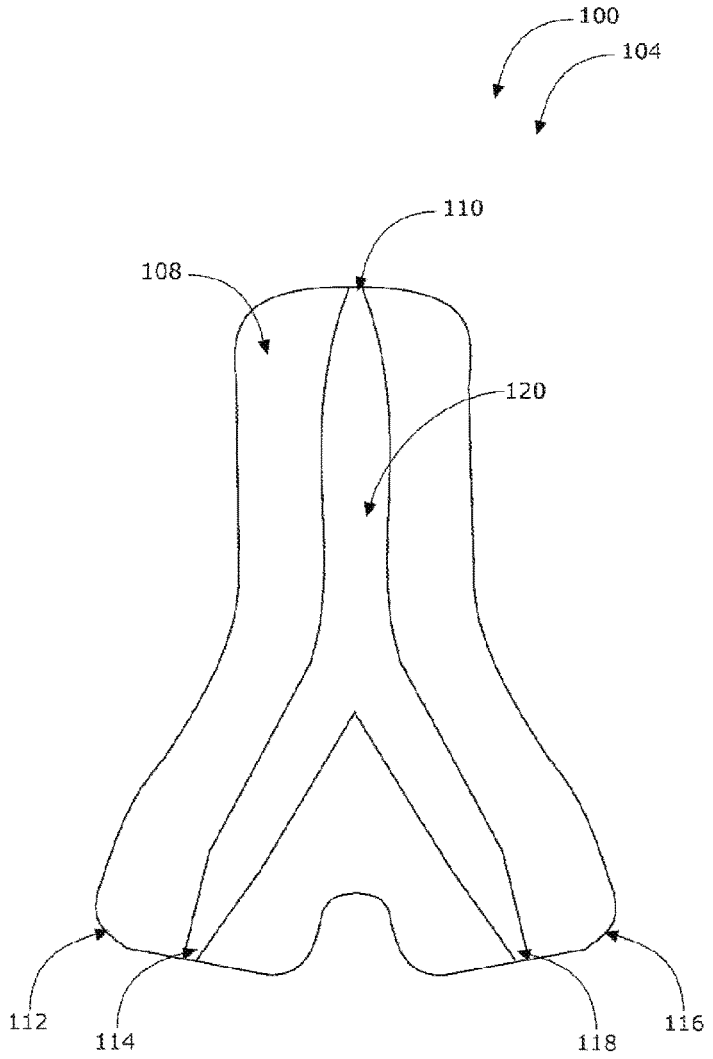
FIG. 2 is a perspective view illustrating the dual masturbator system comprising a Y-shaped assembly according to an embodiment of the present invention of the disclosure.
Figure 3:
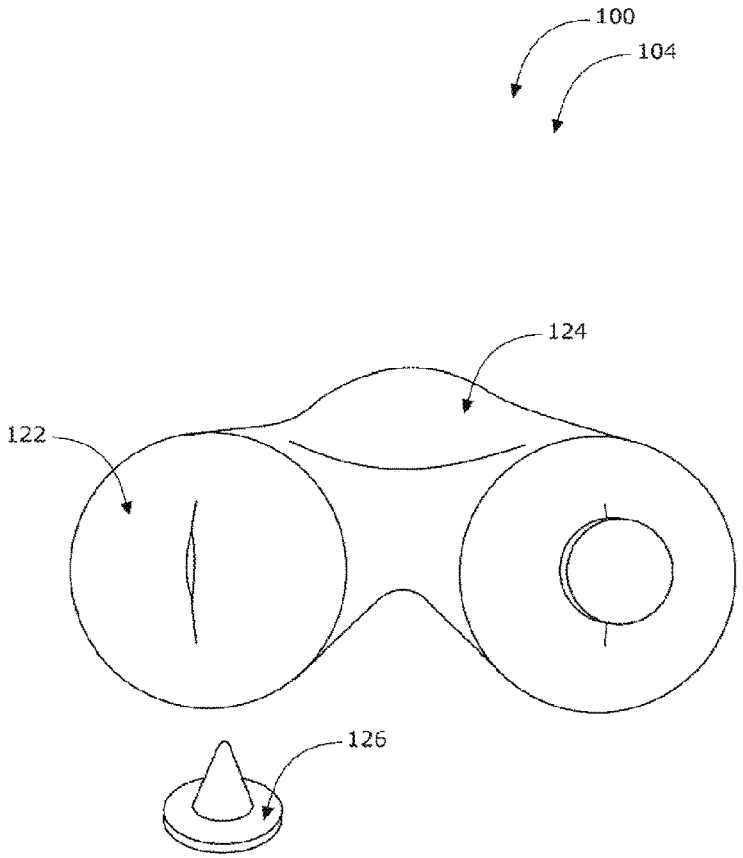
FIG. 3 is a perspective view illustrating the open-end Y-shaped assembly according to an embodiment of the present disclosure.
Figure 4:
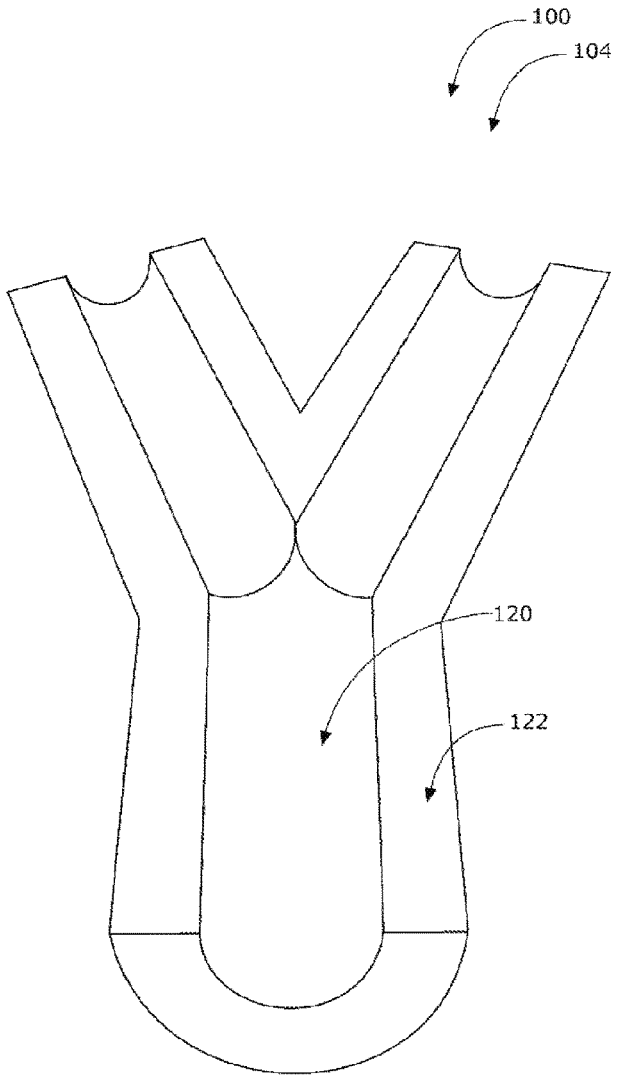
FIG. 4 is a perspective view illustrating a cross section Y-shaped assembly according to an embodiment of the present disclosure.

As discussed above, embodiments of the present disclosure relate to a masturbation device and more particularly to a dual masturbator system as used to improve the ability for two males to masturbate simultaneously using one device and one motion.

Generally speaking, the purpose of the dual male masturbator is to provide an individual the opportunity to experience what was once considered a solo act with a friend, lover, or spouse. The two entryways are strategically placed for maximum pleasure, and only one motion is necessary to satisfy both users. The look of the dual masturbator will not be much different from standard masturbators available. The unique intertwining of the dual entryways helps provide an experience which can be enjoyed simultaneously.

Referring now more specifically to the drawings by numerals of reference there is shown in FIGS. 1-4, various views of dual masturbator system 100 comprising dual masturbator device 104 including y-shaped body 106 having outer-circumference 108 having closed-end 110, open-end-A 112 having, first-orifice 114, and open-end-B 116 having second-orifice 118, inner-cylindrical-tube 120 having, soft-flesh-like-material 122; wherein y-shaped body 106 with outer-circumference 108 is useful for gripping dual masturbator device 104 while holding closed-end 110. Open-end-A 112 has first-orifice 114, and open-end-B 116 having second-orifice 118 permit entry of two male members at once. Inner-cylindrical-tubing 120 comprises soft-flesh-like-material 122. Y-shaped body 106 and inner-cylindrical-tube 120 provides an instrument for masturbatory pleasure of two male members at once.

Dual masturbator device 104 may further comprise an I-shape with orifices at both ends for one-handed operation by either partner of the two male members. Outer-circumference 108 is washable using soap and warm water. The material preferably comprises pliable rubber 124 to provide stability and grippability during use.

Closed-end 110 comprises temporary-removable-plug 126 allowing for a third orifice. Open-end-A 112 having first-orifice 114 accommodates one male penis for a single user 140. Open-end-B 116 having second-orifice 118 accommodates one male penis for dual users. Inner-cylindrical-tube 120 comprises of a flexible composition allowing for expansion and contraction during use.

Inner-cylindrical-tube 120 comprises an air outlet hole for allowing excess air to escape dual masturbator device 104. Inner-cylindrical-tube 120 and soft-flesh-like-material 122 is designed to mimic genital-flesh consistency. Inner-cylindrical-tube 120 and soft-flesh-like-material 122 allows for insertion of a cleaning apparatus. Open-end-B 116 includes temporary-removable-plug 126 to allow proper stimulation for a single user 140. Dual masturbator device 104 may measure less than ten inches in length, exactly ten inches in length, and alternately more than ten inches in length. Dual masturbator device 104 comprises flesh tones to mimic human flesh, and alternately clear material to enhance visual stimulus during use.

Dual masturbator system 100 may be sold as a kit comprising the following parts: at least one dual masturbator device; and at least one set of user instructions. The kit has instructions such that functional relationships are detailed in relation to the structure of the invention (such that the invention can be used, maintained, or the like in a preferred manner).

Dual masturbator system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different coupling combinations, parts may be sold separately, etc., may be sufficient.

Figure 5:
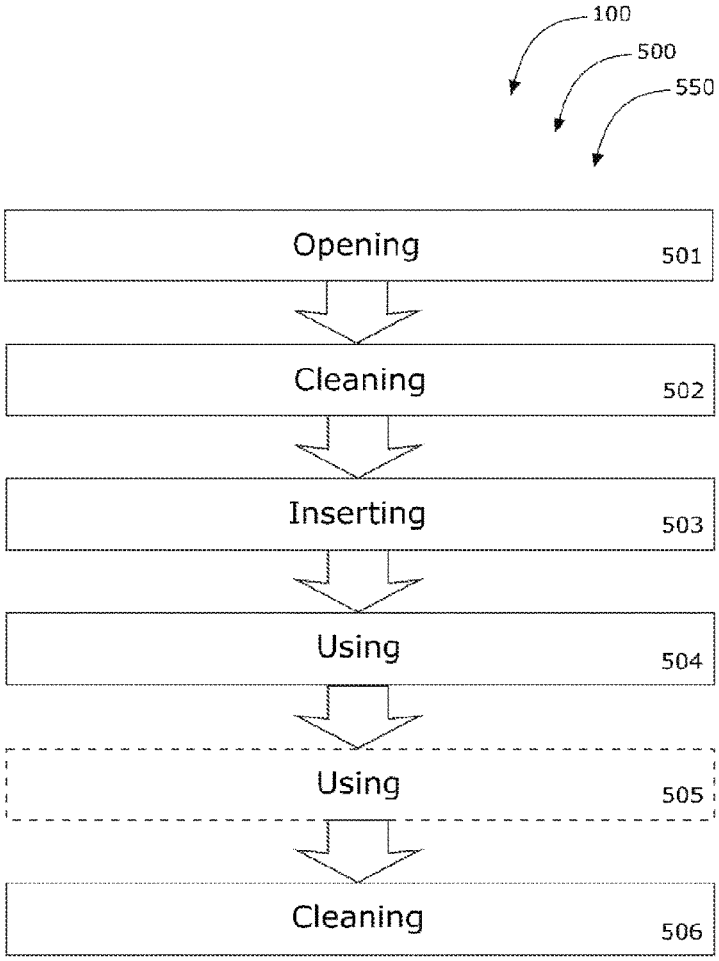
FIG. 5 is a flow diagram illustrating a method of use for the dual masturbator system according to an embodiment of the present disclosure.

Referring now to FIG. 5 showing a flow diagram 550 illustrating method of use 500 for dual masturbator system 100 according to an embodiment of the present invention of FIGS. 1-4. As shown, method of use 500 may comprise the steps of: step one 501, opening dual masturbator device packaging; step two 502, cleaning the dual masturbator device thoroughly before first use; step three 503, inserting up to two male members into the dual masturbator device; step four 504, using the dual masturbator device until desired satisfaction has been achieved; step five 505, using lubricant inside of the dual masturbator device; and step six 506, cleaning the dual masturbator device thoroughly after use.

It should be noted that step 505 is an optional step and may not be implemented in all cases. Optional steps of method of use 500 are illustrated using dotted lines in FIG. 5 so as to distinguish them from the other steps of method of use 500.

It should be noted that the steps described in the method of use can be carried out in many different orders according to user preference. The use of "step of" should not be interpreted as "step for", in the claims herein and is not intended to invoke the provisions of 35 U.S.C. § 112 (f). Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A dual masturbator system comprising: a dual masturbator device including:

a y-shaped-gripper-outer-body having:

an outer-gripper-circumference having: an open-end-A having:

a first-orifice; and an open-end-B having:

a second-orifice; a closed-end comprising:

a temporary-removable-plug thereby providing a third-orifice;

an inner-y-shaped-cylindrical-tube concentric with the y-shaped-gripper-outer-body having a soft-flesh-like-material wherein said y-shaped-gripper-outer-body with said outer-circumference is useful for gripping said dual masturbator device while holding said closed-end;

wherein said open-end-A having said first-orifice, and said open-end-B having said second-orifice permit entry of two male members at once;

wherein said inner-y-shaped-cylindrical-tube comprises said soft-flesh-like-material;

and wherein said y-shaped-gripper-outer-body and said inner-y-shaped-cylindrical-tube provides an instrument for masturbatory pleasure of said two male members at once.

2. The dual masturbator system of claim 1 wherein said dual masturbator device comprises an Y-shape with orifices at said first-orifice at said open-end-A and said third-orifice at said closed-end comprising said temporary-removable-plug for one-handed operation by either partner of said two male members.

3. The dual masturbator system of claim 1 wherein said outer-circumference is washable using soap and warm water.

4. The dual masturbator system of claim 3 wherein said material comprises pliable rubber to provide stability and grippability during use.

5. The dual masturbator system of claim 1 wherein said open-end-A having said first-orifice accommodates one male penis for a single user.

6. The dual masturbator system of claim 1 wherein said open-end-B having said second-orifice accommodates one male penis for dual users.

7. The dual masturbator system of claim 6 wherein said open-end-B includes said temporary-removable-plug to allow proper stimulation for a single user.

8. The dual masturbator system of claim 1 wherein said inner-y-shaped-cylindrical-tube consists of a flexible composition allowing for expansion and contraction during use.

9. The dual masturbator system of claim 8 wherein said inner-y-shaped-cylindrical-tube comprises an air outlet hole for allowing excess air to escape said dual masturbator device.

10. The dual masturbator system of claim 9 wherein said inner-y-shaped-cylindrical-tube and said soft-flesh-like-material is designed to mimic genital-flesh consistency.

11. The dual masturbator system of claim 10 wherein said inner-y-shaped-cylindrical-tube and said soft-flesh-like-material allows for insertion of a cleaning apparatus.

12. The dual masturbator system of claim 1 wherein said dual masturbator device comprises flesh tones to mimic human flesh.

13. The dual masturbator system of claim 1 wherein said dual masturbator device measures less than ten inches in length.

14. The dual masturbator system of claim 13 wherein said dual masturbator device measures exactly ten inches in length.

15. The dual masturbator system of claim 14 wherein said dual masturbator device measures more than ten inches in length.

16. A dual masturbator system comprising:

a dual masturbator device including a y-shaped-gripper-outer-body having an outer-circumference having a closed-end;

an open-end-A having a first-orifice; and an open-end-B having a second-orifice; and an inner-y-shaped-cylindrical-tube concentric with the y-shaped-gripper-outer-body tube having a soft-flesh-like-material;

wherein said dual masturbator device measures exactly ten inches in length;

wherein said dual masturbator device comprises flesh tones to mimic human flesh;

wherein said y-shaped-gripper-outer-body with said outer-circumference is useful for gripping said dual masturbator device while holding said closed-end;

wherein said outer-circumference is washable using soap and warm water;

wherein said closed-end comprises a temporary-removable-plug allowing for a third orifice;

wherein said open-end-A having said first-orifice, and said open-end-B having said second-orifice permit entry of two male members at once;

wherein said open-end-A having said first-orifice accommodates one male penis for a single user;

wherein said open-end-B having said second-orifice accommodates one male penis for dual users;

wherein said open-end-B includes said temporary-removable-plug to allow proper stimulation for a single user;

wherein said inner-y-shaped-cylindrical-tube consists of a flexible composition allowing for expansion and contraction during use;

wherein said inner-y-shaped-cylindrical-tube comprises an air outlet hole for allowing excess air to escape said dual masturbator device;

wherein said inner-y-shaped-cylindrical-tube and said soft-flesh-like-material is designed to mimic genital-flesh consistency;

wherein said inner-y-shaped-cylindrical-tube and said soft-flesh-like-material allows for insertion of a cleaning apparatus;

wherein said material comprises pliable rubber to provide stability and grippability during use; and wherein said y-shaped-gripper-outer-body and said inner-y-shaped-cylindrical-tube provides an instrument for masturbatory pleasure of said two male members at once.

17. The dual masturbator system of claim 16 further comprising a kit including:

a dual masturbator device; and a set of user instructions.

18. A method of using said dual masturbator system of claim 16 comprising the steps of:

opening dual masturbator device packaging;

cleaning said dual masturbator device thoroughly before first use;

inserting up to two male members into said dual masturbator device;

using said dual masturbator device until desired satisfaction has been achieved; and cleaning said dual masturbator device thoroughly after use.

19. The method of claim 18 further comprising the steps of:

using lubricant inside of said dual masturbator device.

* * * * *